US006308689B1

(12) United States Patent
Augustin

(10) Patent No.: US 6,308,689 B1
(45) Date of Patent: Oct. 30, 2001

(54) INJECTION VALVE FOR AN INTERNAL COMBUSTION ENGINE

(75) Inventor: Ulrich Augustin, Kernen (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/523,374

(22) Filed: Mar. 10, 2000

(30) Foreign Application Priority Data

Mar. 10, 1999 (DE) ..... 199 10 589

(51) Int. Cl.[7] ..... F02M 45/04
(52) U.S. Cl. ..... 123/506
(58) Field of Search ..... 123/506, 299, 123/300; 239/96

(56) References Cited

U.S. PATENT DOCUMENTS 6,029,632 * 2/2000 Augustin ..... 123/506
6,112,721 * 9/2000 Kouketsu et al. ..... 123/447

* cited by examiner

*Primary Examiner*—Tony M. Argenbright
*Assistant Examiner*—Hyder Ali

(57) ABSTRACT

An injection valve for an internal combustion engine, including a servo valve having a movable valve element providing a constriction in the fuel path to the injection nozzle during an initial phase of the injection. The movable valve element includes a piston-like projection above a groove that, during the main phase of the injection period, emerges from a bore and thereby opens a direct path for the fuel that bypasses the constriction.

15 Claims, 1 Drawing Sheet

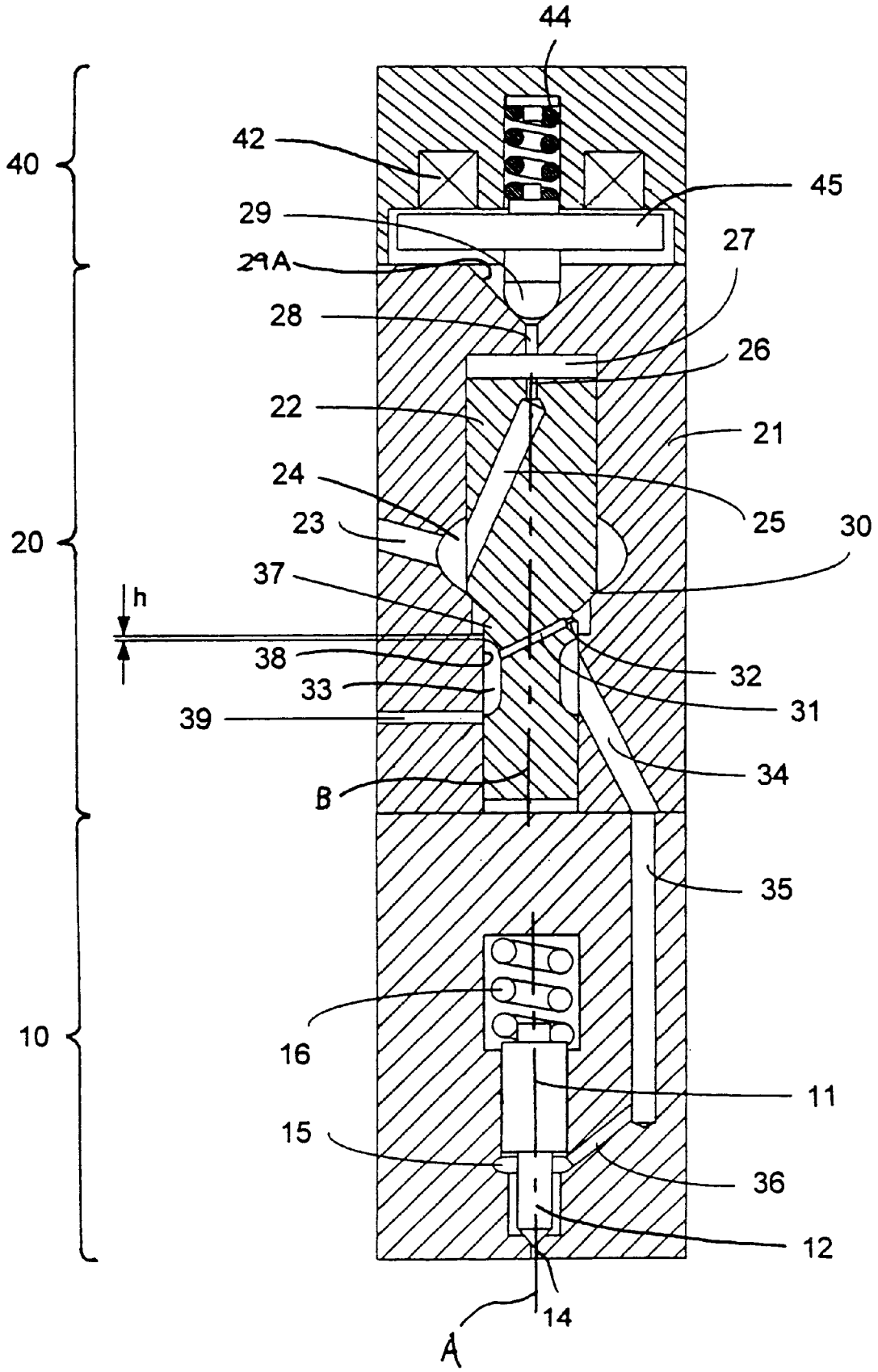
44
42
45
40
29
27
29A
28
26
22
21
24
25
23
30
20
37
h
38
32
33
31
39
34
B
35
10
16
11
15
36
12
14
A

INJECTION VALVE FOR AN INTERNAL COMBUSTION ENGINE

CROSS REFERENCE TO RELATED APPLICATIONS

This application claims the benefit of priority based on German Application No. 19910589.8, filed on Mar. 10, 1999, which is incorporated by reference herein in its entirety.

BACKGROUND OF THE INVENTION

The invention relates to an injection valve. It is known to supply internal combustion engines with fuel using fuel injection systems that operate with a very high injection pressure. Such injection systems are commonly referred to known as common rail systems (for Diesel engines) and PDI injection systems (for Otto cycle engines). In conventional injection systems, fuel is pumped with a high-pressure pump into a pressure reservoir common to all cylinders of the engine. Injection valves supply fuel from the reservoir to individual cylinders. The opening and closing of the injection valves, also known as injectors, is conventionally performed electrically or electromagnetically.

The injection valves in conventional systems are generally provided with servo valves that hydraulically operate the opening and closing of the needle of the actual injection valve, i.e., the servo valves determine the beginning and the end of the injection period. The servo valve, in connection with other features of these systems, mainly influences the speed at which the injection valve opens and closes.

For reasons relating to combustion technology, the speed that the injection valve opens is chosen to be different from the speed that the injection valve closes. The injection valve must, in common rail systems for Diesel engines, open slowly under control at the start of the injection period for better mixing of the fuel with the air. On the other hand, the injection valve must close rapidly at the end of the injection so as to prevent carbon deposit formation. Also, the period of the injection must be controllable. In order to optimize the combustion process, it is desirable to minimize pilot injection, i.e., the amount of fuel that is injected before the actual injection.

Uncontrolled opening of the injection valve can lead to violent pressure fluctuations, which are difficult to overcome, in the high-pressure range of the injection nozzle. By appropriate measures such as control throttling in the fuel delivery, the injection can be controlled at the beginning. Control throttling also has the advantage that the requirements regarding valve timing are substantially less stringent.

A disadvantage of these conventional systems and their known manner of operation is that fuel delivery is not controlled only in the initial phase of the injection, but also when a transition is made from the initial phase to the main phase of the injection, which is to take place as rapidly as possible.

SUMMARY OF THE INVENTION

The present invention is directed to providing an injection valve with a control valve such that the initial phase of the injection period can be started with throttling, and eliminating the undesirable effects of throttling later in the injection period.

A servo valve according to the present invention is characterized in that, during the initial phase of the injection period, the servo valve includes a constricted connection to the injection nozzle of the injection system. As the injection continues, when the servo valve opens further, the initially active constriction is bypassed, and a direct connection to the injection nozzle is established.

The present invention is achieved by providing an injection valve for controlling fuel flow from an inlet passage to an injection nozzle. The injection valve comprises a valve body including a valve seat and a bore; a valve element displaceable with respect to the valve body, the valve element sealingly engaging the valve seat and preventing the fuel flow at a closed position of the valve element with respect to the valve body, the valve element including a piston sealingly engaging a wall of the bore in the closed position, a groove confronting the valve body, and a passage having a constriction providing fluid communication between an upstream side of the piston and the groove, the bore having a radially flared portion located at a predetermined length from the groove in the closed position; a control chamber regulating displacement of the valve element with respect to the valve body, displacement less than the predetermined length from the closed position establishing fluid communication between the inlet passage and the injection nozzle through the passage, and displacement in excess of the predetermined length establishing a direct connection between the inlet passage and the injection nozzle; and an actuator controlling pressure in the control chamber.

The present invention is also achieved by providing a valve for controlling fluid flow between a fluid inlet and a fluid outlet. The valve comprises a valve body including a first valve seat and a second valve seat; and a valve element displaceable with respect to the valve body between a first configuration and a second configuration. The valve element includes a first valve portion sealingly engaging the first valve seat in the first configuration to prevent fluid flow, and being sufficiently separated from the first valve seat in the second configuration to permit fluid flow at an unrestricted rate between the fluid inlet and the fluid outlet; a second valve portion sealingly engaging the second valve seat in the first configuration and separating from the second valve seat at a third configuration of the valve element with respect to the valve seat, the third configuration occurring at an intermediate displacement between the first and second configurations; and a passage extending through the second valve portion and permitting fluid flow at a restricted rate between the fluid inlet and the fluid outlet during displacement between the first and third configurations.

The present invention is further achieved by providing a method of controlling fuel flow from an inlet passage to an injection nozzle. The method comprises providing a valve interposed in the fluid flow between the inlet passage and the injection nozzle; actuating the valve to initially provide a first rate of the fuel flow through the valve; and further actuating the valve to subsequently provide a second rate of the fuel flow through the valve, the second rate being greater than the first rate.

BRIEF DESCRIPTION OF THE DRAWING

The accompanying drawing, which is incorporated herein and constitutes part of this specification, illustrates presently preferred embodiments of the invention, and, together with the general description given above and the detailed description given below, serves to explain features of the present invention.

The sole FIGURE is a schematic illustration showing an injector for a fuel injection system with a servo valve according to the present invention.

DETAILED DESCRIPTION OF THE PREFERRED EMBODIMENTS

Referring to the figure, a fuel injection system, which can be a common rail system of a Diesel engine, consists substantially of three elements that are combined in one unit. The first element of the injection system is an injection nozzle 10 for injecting fuel into a combustion chamber (not shown) of an internal combustion engine (not shown) during the combustion process. The second element is a servo valve 20 in fluid communication with the injection nozzle 10. The third element is a control unit 40 for operating the servo valve 20. The control unit 40 can operate the servo valve 20 piezo-electrically or electromagnetically. In the figure, the control unit 40 electromagnetically operates the servo valve 20.

The injection nozzle 10 comprises a nozzle body 11 that is movable along an axis A. At a downstream end of the nozzle body 11, a nozzle needle 12 opens and closes injection holes 14 as a result of axial movement of the nozzle body 11. The injection holes 14 are in fluid communication with the combustion chamber of the internal combustion engine. The nozzle needle 12 opens the injection holes 14 when fuel is delivered under high pressure to a nozzle chamber 15 at the front end of the nozzle body 11, i.e., the nozzle body 11 moves away axially from the injection holes 14 against the action of a compression spring 16.

The servo valve 20 comprises a valve body 21 into which a valve element 22 is inserted for movement along an axis B. The axes A and B can be aligned, can be parallel, or can be angularly related with respect to one another. A high-pressure reservoir such as a fuel rail (not shown), is in fluid communication with an inlet passage 23 of the valve body 22. The inlet passage 23 is in fluid communication with a groove 24 encircling the valve element 22.

The valve element 22 includes a passage 25, which includes an inlet constriction 26, provides fluid communication from the groove 24 to a control chamber 27 at an upper end of the valve element 22. The valve body 21 includes an outlet constriction 28 in a fluid communication path between the control chamber 27 and a ball valve 29, which in its closed position (as shown), rests upon a conical valve seat 29A. Separating the ball valve 29 from the conical valve seat 29A allows fluid flow from the control chamber 27 to a return (not shown) that is not pressurized or at a relatively low pressure.

Fluid flow out of the groove 24 is through a valve seat 30 that is formed by an inwardly directed ledge on the valve body 21 cooperatively engaging a shoulder on the tapering valve element 22. When a fluid (e.g., fuel) is present under pressure in the control chamber 27, the valve element 22 is forced against the valve seat 30. Thus, the servo valve 20 is in the closed state, as shown in the figure.

A passage 31 is in fluid communication with the valve seat 30. The passage 31, which extends through the valve element 22 and includes a constriction 32 is in fluid communication with a ring-shaped groove 33 formed in the valve element 22. Passages 34, 35 and 36, which extend through the valve body 21 and body of the injection nozzle 10, provide fluid communication between the groove 33 and the nozzle chamber 15 of the injection nozzle 10.

The valve element 22 also includes a piston-like projection that substantially sealingly contacts the wall of a bore 38 in the valve body 21 when the servo valve 20 is closed and the valve element 22 lies on the valve seat 30. The bore 38 includes a step-wise, radially enlarged section beginning at an axial distance h from the edge of groove 33 (when the servo valve 20 is closed) and extending to the valve seat 30. The distance h is less than the stroke of the servo valve 20 between the fully closed and the fully open position. The distance h is sufficiently great so that, when the valve element 22 begins to lift off from the valve seat 30, fluid communication directly between the radially enlarged section of the bore 38 and the groove 33 is prevented.

When the servo valve 20 is closed, a drainage bore 39 provides fluid communication between the groove and a leakage return that is not pressurized or at a low pressure. When the servo valve 20 is open, valve element closes the drainage bore 39.

The control unit 40 can include one or more electromagnets 42 and a spring 44. When the electromagnets 42 are dc-energized, the spring 44 urges the ball valve 29 of servo valve 20 onto its seat, thereby closing off the control chamber 27. If the electromagnet 42 is energized, an armature 45 fastened to the ball valve 29 is attracted by the electromagnet 42 against the action of the spring 44, so that the ball valve 29 opens.

Instead of the magnet unit 40, other techniques of externally operating the ball valve 29 can be employed. For example, piezo-electric elements can be used instead of the electromagnet 42.

The operation of the injector according to the present invention will now be described. At an initial configuration, no current flows through the electromagnet 42. The control chamber 27 is in fluid communication through the inlet constriction 26, the passage 25, the groove 24 and the inlet passage 23 with the high-pressure fuel reservoir (e.g., fuel rail). Thus, fuel under pressure is present in the control chamber 27. The valve element 22 is forced into the valve seat 30 by the pressure in the control chamber 27, and the servo valve 20 is closed.

External action, such as energizing the electromagnet 42, causes the ball valve 29 to open, so that fuel can flow from the control chamber 27 through the outlet constriction 28 to the pressure-less return. The inlet constriction 26 and outlet constriction 28 are of such sizes that pressure in the control chamber is relieved when the ball valve 29 is open, e.g., the outlet constriction 28 can be larger than the inlet constriction 26.

By relieving pressure in the control chamber 27, the valve element 22 is moved by the fuel under pressure toward the control chamber 27, so that the valve seat 30 is opened and the connection between groove 33 and the drainage bore 39 is interrupted. During the first portion of the opening phase, i.e., while the valve stroke is shorter than the distance h, fuel that is under high pressure passes out of groove 24, over the valve seat 30, through the constriction 32 and the passage 31, into the groove 33, and through the passages 34, 35, 36, into the nozzle chamber 15 of the injection nozzle 10. Thus, the nozzle body 11 and the nozzle needle 12 are displaced against the bias of compression spring 16 by pressure build-up in the nozzle chamber 15, thereby permitting fluid flow through the injection holes 14.

During the main phase, i.e., at such time as the stroke of the valve element 22 exceeds the distance h, the piston-like projection passes out of the bore 38 and opens a flow cross-section that is relatively larger than through the constriction 32 and the passage 31. In this main phase of the injection, the constriction 32 is bypassed, thereby opening a direct connection between valve seat 30 and groove 33, and thus an unconstricted connection between the high-pressure reservoir (e.g., the fuel rail) and the injection nozzle 10.

The end of the injection period begins by closing the ball valve 29, e.g., dc-energizing the electromagnet 42. The pressure in the control chamber 27 rises again, and the valve element 22 moves toward the injection nozzle 10 and closes the valve seat 30. Fluid communication from the groove 33 through the drain bore 39 is re-established, thereby relieving pressure in the injection nozzle 10. Pressure relief of the injection nozzle 10 through the drain bore 39 in the closing phase accelerates the closing action.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. An injection valve for controlling fuel flow from an inlet passage to an injection nozzle, the injection valve comprising:

a valve body including a valve seat and a bore;

a valve element displaceable with respect to the valve body, the valve element sealingly engaging the valve seat and preventing the fuel flow at a closed position of the valve element with respect to the valve body, the valve element including a piston sealingly engaging a wall of the bore in the closed position, a groove confronting the valve body, and a passage having a constriction providing fluid communication between an upstream side of the piston and the groove, the bore having a radially flared portion located at a predetermined length from the groove in the closed position;

a control chamber regulating displacement of the valve element with respect to the valve body, displacement less than the predetermined length from the closed position establishing fluid communication between the inlet passage and the injection nozzle through the passage, and displacement in excess of the predetermined length establishing a direct connection between the inlet passage and the injection nozzle; and an actuator controlling pressure in the control chamber.

2. The injection valve according to claim 1, wherein the valve element is displaced a predetermined stroke from the closed position to an open position, the predetermined length being less than the predetermined stroke.

3. The injection valve according to claim 1, wherein the valve body also includes a drainage bore in fluid communication with the groove in the closed position, this fluid communication being interrupted by the displacement of the valve element with respect to the valve body.

4. The injection valve according to claim 1, wherein the actuator includes an electromagnet.

5. The injection valve according to claim 1, wherein the actuator includes a piezoelectric element.

6. A valve for controlling fluid flow between a fluid inlet and a fluid outlet, the valve comprising:

a valve body including a first valve seat and a second valve seat;

a valve element displaceable with respect to the valve body between a first configuration and a second configuration, the valve element including:

a first valve portion sealingly engaging the first valve seat in the first configuration to prevent fluid flow, and being sufficiently separated from the first valve seat in the second configuration to permit fluid flow at an unrestricted rate between the fluid inlet and the fluid outlet;

a second valve portion sealingly engaging the second valve seat in the first configuration and separating from the second valve seat at a third configuration of the valve element with respect to the valve seat, the third configuration occurring at an intermediate displacement between the first and second configurations; and a passage extending through the second valve portion and permitting fluid flow at a restricted rate between the fluid inlet and the fluid outlet during displacement between the first and third configurations.

7. The valve according to claim 6, wherein the passage includes a fluid flow constriction.

8. The valve according to claim 6, further comprising:

a pressure chamber defined by the valve body and the valve element, the pressure chamber being in fluid communication with the fluid inlet; and a relief valve operable between a first position containing fluid pressure in the pressure chamber and a second position venting the pressure chamber, the first position of the relief valve displacing the valve element toward the first configuration and the second position of the relief valve permitting the valve element to be displaced toward the second configuration.

9. The valve according to claim 8, further comprising:

a second passage extending through the valve element and providing the fluid communication between the fluid inlet and the pressure chamber; and a third passage extending through the valve body and providing fluid communication between the pressure chamber and the relief valve.

10. The valve according to claim 9, wherein the second passage includes an inlet constriction and the third passage includes a outlet constriction, the inlet constriction restricting fluid flow more than the outlet constriction.

11. The valve according to claim 8, further comprising:

an actuator operating the relief valve.

12. The valve according to claim 11, wherein the actuator is selected from the group consisting of an electromagnetic actuator and a piezo-electric actuator.

13. The valve according to claim 8, further comprising:

a resilient element biasing the relief valve toward the first arrangement.

14. A method of controlling fuel flow from an inlet passage to an injection nozzle, the method comprising:

providing a valve interposed in the fluid flow between the inlet passage and the injection nozzle;

actuating the valve to initially provide a first rate of the fuel flow through the valve, wherein the actuating the valve includes directing the fuel flow through a constricted passage; and further actuating the valve to subsequently provide a second rate of the fuel flow through the valve, the second rate being greater than the first rate.

15. The method according to claim 14, wherein the further actuating the valve includes bypassing the fuel flow around the constricted passage.

* * * * *